US008075091B2

(12) United States Patent
Koike et al.

(10) Patent No.: US 8,075,091 B2
(45) Date of Patent: Dec. 13, 2011

(54) FLUID EJECTING APPARATUS AND METHOD OF CONTROLLING THE FLUID EJECTING APPARATUS

(75) Inventors: Kaoru Koike, Matsumoto (JP); Toshio Kumagai, Shiojiri (JP); Hiroki Matsuoka, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/717,287

(22) Filed: Mar. 4, 2010

(65) Prior Publication Data

US 2010/0224693 A1 Sep. 9, 2010

(30) Foreign Application Priority Data

Mar. 5, 2009 (JP) ..... 2009-052461

(51) Int. Cl.
*B41J 2/165* (2006.01)

(52) U.S. Cl. ..... 347/34

(58) Field of Classification Search ..... 347/34, 347/102
See application file for complete search history.

(56) References Cited

U.S. PATENT DOCUMENTS

2004/0061738 A1* 4/2004 Unosawa ..... 347/34

FOREIGN PATENT DOCUMENTS

| | | |
|---|---|---|
| JP | 2001-191558 | 7/2001 |
| JP | 2006-076023 | 3/2006 |
| JP | 2007-160607 | 6/2007 |

* cited by examiner

*Primary Examiner* — Julian Huffman
(74) *Attorney, Agent, or Firm* — Workman Nydegger

(57) ABSTRACT

A fluid ejecting apparatus includes a nozzle that ejects fluid; a transporting section that transports in a direction of transportation a medium on which the fluid lands; and a mist sucking section that sucks air including a mist portion when the nozzle ejects the fluid, so as to move the mist portion from a route that extends from the nozzle to the spot on the medium where the fluid lands. The mist portion is a portion of mist, which is part of the fluid ejected by the nozzle that does not land on the medium and is floating.

6 Claims, 8 Drawing Sheets

FLUID EJECTING APPARATUS AND METHOD OF CONTROLLING THE FLUID EJECTING APPARATUS

This application claims the benefit of Japanese Patent Application No. 2009-052461, filed Mar. 5, 2009, which is expressly incorporated herein by reference in its entirety.

BACKGROUND

1. Technical Field

The present invention relates to a fluid ejecting apparatus and a method of controlling the fluid ejecting apparatus.

2. Related Art

There are fluid ejecting apparatuses having a nozzle that ejects fluid, a transporting section that transports in a direction of transportation a medium on which the fluid lands, and a mist sucking section that sucks air including mist that is part of the fluid ejected by the nozzle and that does not land on the medium and is floating (for example, see JP-A-2007-160607).

SUMMARY

If the mist floating in a fluid ejecting apparatus collides with an ink droplet ejected from a nozzle before the ink droplet lands on the medium, the image quality may be degraded.

An advantage of some aspects of the invention is that the image quality is improved.

An aspect of the invention is a fluid ejecting apparatus including a nozzle that ejects fluid; a transporting section that transports in a direction of transportation a medium on which the fluid lands; and a mist sucking section that sucks air including a mist portion when the nozzle ejects the fluid, so as to move the mist portion from the route along which the fluid travels after being ejected from the nozzle until landing on the medium. The mist portion is a portion of mist, which is part of the fluid ejected by the nozzle that does not land on the medium and is floating.

Other features of the invention will become apparent from the description of the specification and the appended drawings.

DESCRIPTION OF EXEMPLARY EMBODIMENTS

Figure 1:
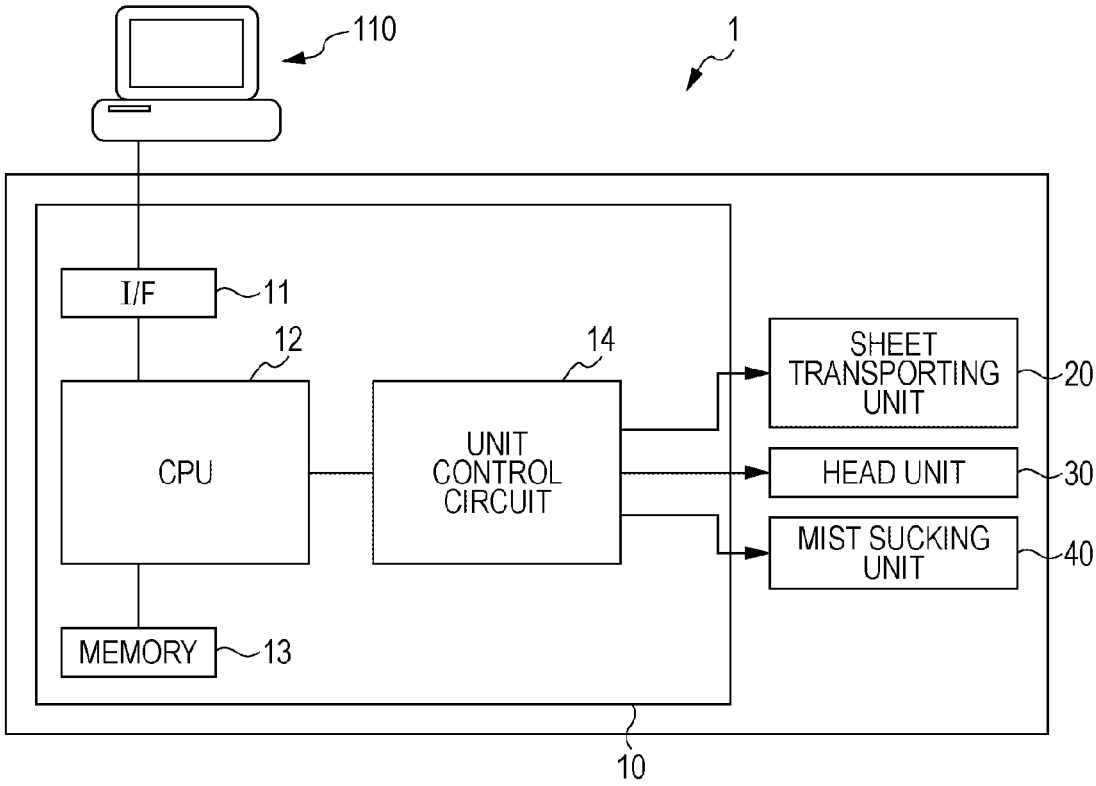
FIG. 1 is a block diagram schematically illustrating the general configuration of a printer.

At least the following will become apparent from the description of the specification and the appended drawings.

There is provided a fluid ejecting apparatus including a nozzle that ejects fluid; a transporting section that transports in a direction of transportation a medium on which the fluid lands; and a mist sucking section that sucks air including a mist portion when the nozzle ejects the fluid, so as to move the mist portion from a route that extends from the nozzle to the spot on the medium where the fluid lands. The mist portion is a portion of mist, which is part of the fluid ejected by the nozzle that does not land on the medium and is floating.

By using this fluid ejecting apparatus, the image quality can be improved.

It is preferable that the mist sucking section of the fluid ejecting apparatus suck air including the mist portion that is generated by an ejection, so as to move the mist portion from the route in a predetermined time period between the ejection and the next ejection.

By using this fluid ejecting apparatus, every time a mist portion is generated, the mist portion can be immediately moved from the route. Therefore, collision of ink droplets with mist-form ink can be avoided.

It is preferable that the mist sucking section of the fluid ejecting apparatus suck air including the mist portion such that the formula $$v_m \geq \frac{r_m}{t_n - \frac{d_{pg}}{v_d}}$$

is satisfied, where $v_m$ [m/s] is the speed of movement of the mist portion in the direction of the mist sucking section, $t_n$ [s] is the predetermined time period, $v_d$ [m/s] is the speed of the fluid ejected by the nozzle, $d_{pg}$ [m] is the distance between the nozzle and the medium, and $r_m$ [m] is the radius of the mist portion.

By using this fluid ejecting apparatus, collision of ink droplets with mist-form ink can be reliably avoided.

It is preferable that the mist sucking section of the fluid ejecting apparatus be disposed on the downstream side of the nozzle in the direction of transportation.

By using this fluid ejecting apparatus, with the aid of the flow of air that is generated when the transporting section transports the medium, the mist sucking section can suck the mist portion efficiently.

It is preferable that the fluid ejecting apparatus include a head that has the nozzle, and an air supplying section that is provided between the mist sucking section and the head, and that supplies air.

By using this fluid ejecting apparatus, the mist sucking section can suck the mist portion smoothly because the air supplying section supplies air. When the mist sucking section sucks a large amount of air, the flow of air between the head and the medium becomes fast and the route along which an ink droplet ejected by the nozzle flies may be bent towards the mist sucking section. However, when the air supplying section supplies air, adverse effects on the flight route of the ink droplet can be prevented.

Moreover, there is provided a method of controlling a fluid ejecting apparatus. The method includes providing a fluid ejecting apparatus, the fluid ejecting apparatus having a nozzle that ejects fluid, a transporting section that transports in a direction of transportation a medium on which the fluid lands, and a mist sucking section that sucks air including a mist portion, the mist portion being a portion of mist, which is part of the fluid ejected by the nozzle that does not land on the medium and is floating; and controlling the mist sucking section when the nozzle ejects the fluid, so as to move the mist portion from the route along which the fluid travels after being ejected from the nozzle until landing on the medium.

By using this method of controlling a fluid ejecting apparatus, the image quality can be improved.

First Embodiment

Configuration of Ink Jet Printer

Figure 2:
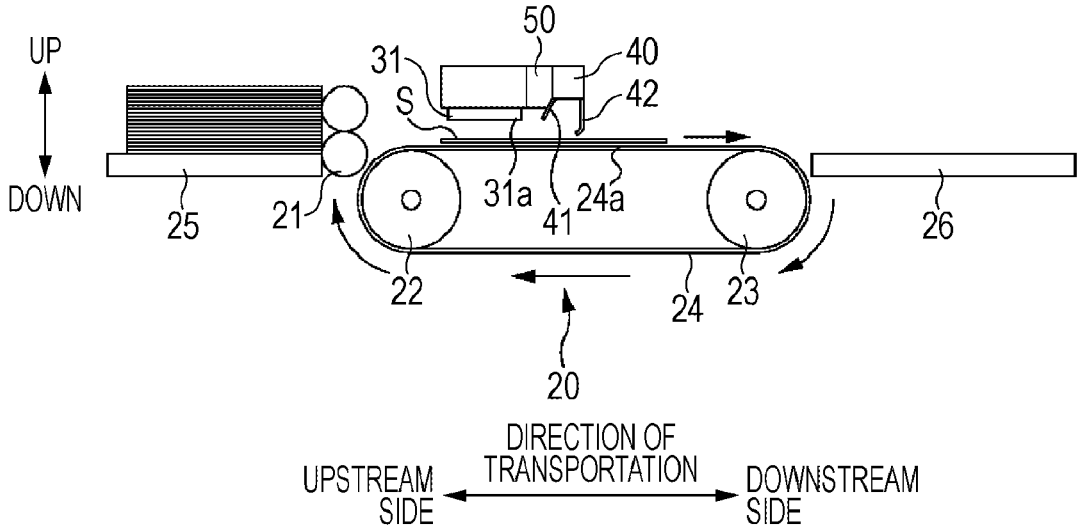
FIG. 2 is a schematic diagram illustrating the configuration of the interior of the printer.
Figure 3:
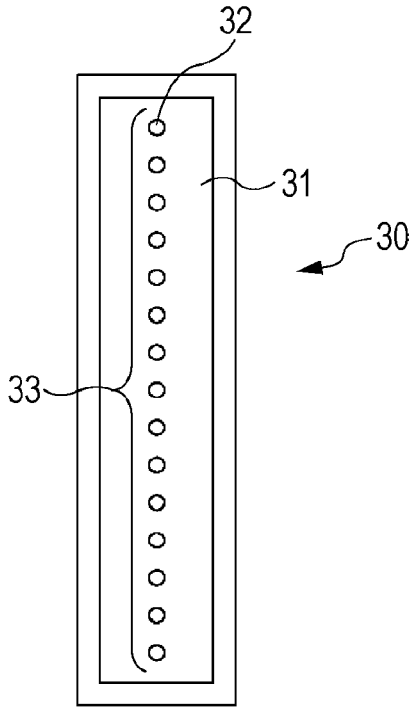
FIG. 3 is a schematic diagram illustrating a head unit having a nozzle row.
Figure 4:
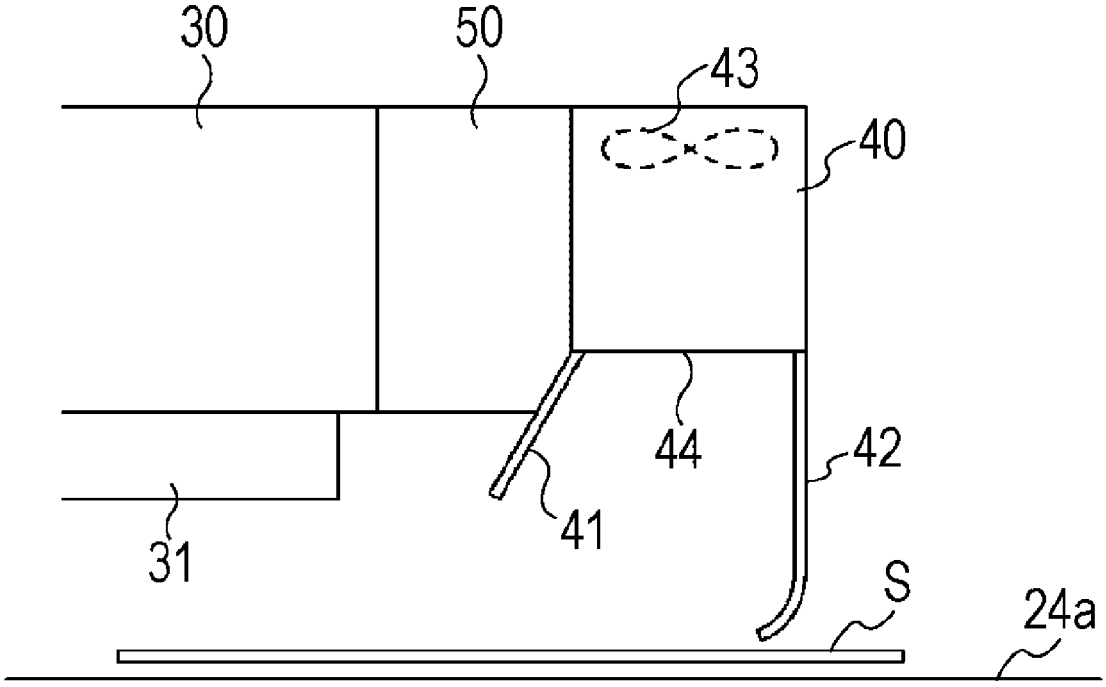
FIG. 4 is a schematic diagram illustrating the configuration of a mist guiding section that guides mist to a mist sucking unit.

The configuration of an ink jet printer 1 (hereinafter referred to simply as "a printer 1") that uses a fluid ejecting apparatus according to a first embodiment of the invention will be described below with reference to FIGS. 1 to 4. FIG. 1 is a block diagram schematically illustrating the general configuration of the printer 1. FIG. 2 is a schematic diagram illustrating the configuration of the interior of the printer 1. FIG. 3 is a schematic diagram illustrating a head unit 30 that has a nozzle row. FIG. 4 is a schematic diagram illustrating the configuration of a mist guiding section 42 that guides mist to a mist sucking unit 40.

When the printer 1 receives data of printing from an external computer 110, a controller 10 controls each of a sheet transporting unit 20, a head unit 30, and a mist sucking unit 40, and forms an image on a sheet S, which is a medium.

The controller 10 is a control unit that controls the printer 1. An interface 11 allows transmission and reception of data between the external computer 110 and the printer 1. A CPU 12 is an operation processor that controls the entire printer 1. A memory 13 provides an area in which programs for the CPU 12 are stored, an area for work, and the like. The CPU 12 controls the units through a unit control circuit 14 in accordance with the programs stored in the memory 13.

The sheet transporting unit 20 is a medium-transporting mechanism that feeds a sheet S to a position where printing is possible, and that transports the sheet S in a direction of transportation by a predetermined amount of transportation during printing. As shown in FIG. 2, the sheet transporting unit 20 has a sheet feed roller 21, transporting rollers 22 and 23, and a transporting belt 24.

The sheet feed roller 21 rotates to feed sheets S stacked on a sheet feed tray 25 onto the transporting belt 24. The transporting rollers 22 and 23 rotate to cause the ring-form transporting belt 24 to rotate in the direction indicated by arrows in FIG. 2. The transporting belt 24 rotates to transport a sheet S in a direction of transportation while supporting the sheet S by a supporting surface 24*a*. The sheet S transported by the transporting rollers 22 and 23 and the transporting belt 24 is discharged onto a sheet discharge tray 26.

The head unit 30 forms dots on the sheet S by ejecting, at a predetermined time interval $t_n$ [s], ink (fluid) to the sheet S that is being transported. The head unit 30 has a fluid ejecting head 31 (hereinafter referred to simply as "a head 31") that ejects ink to the sheet S that is supported by the transporting belt 24, which faces the head 31. As shown in FIG. 3, the head 31 has a plurality of nozzles 32 that eject ink, arrayed in a row.

Each of the nozzles 32 has a pressure chamber (not shown) that contains ink, and a driving element (piezoelectric element) that changes the volume of the pressure chamber to eject ink. The length of the nozzle row 33 in the direction in which the nozzles are arrayed is greater than the length of the sheet S in that direction (that is, the width of the sheet S). Therefore, dots are formed over the entire width of the sheet S each time ink is ejected by the head 31.

The mist sucking unit 40 is disposed on the downstream side in the direction in which the sheet transporting unit 20 performs transportation. The mist sucking unit 40 sucks air including mist-form ink (hereinafter referred to simply as "mist"). The mist-form ink is the part of ink ejected by the nozzles 32 that does not land on the sheet S and is floating. More specifically, the mist sucking unit 40 sucks air by rotation of a fan 43 provided therein.

The mist sucking unit 40 has a suction port 44 through which the mist is sucked, and a first mist guiding section 41 and a second mist guiding section 42 that guide the mist to the suction port 44. As shown in FIG. 4, the first mist guiding section 41 is a plate-form member of the mist sucking unit 40. The first mist guiding section 41 extends from the end of the suction port 44 that is closer to the nozzles 32 towards the sheet S, and is inclined towards the head-unit-30 side. The second mist guiding section 42 is a plate-form member of the mist sucking unit 40. The second mist guiding section 42 extends from the end of the suction port 44 that is farther from the nozzles 32 towards the sheet S, and bends towards the head-unit-30 side, so as to pick up air above the sheet S.

An air supplying unit 50 is provided between the head unit 30 and the mist sucking unit 40, and supplies air above the sheet S. The air supplying unit 50 may be a hollow rectangular parallelepiped member that is open at the upper and lower sides. Alternatively, the air supplying unit 50 may be a gap between the head unit 30 and the mist sucking unit 40. The air supplied by the air supplying unit 50 is sucked by the mist sucking unit 40 together with the air that includes mist.

Suction of Mist

First, explanation about mist will be given.

Figure 5A:
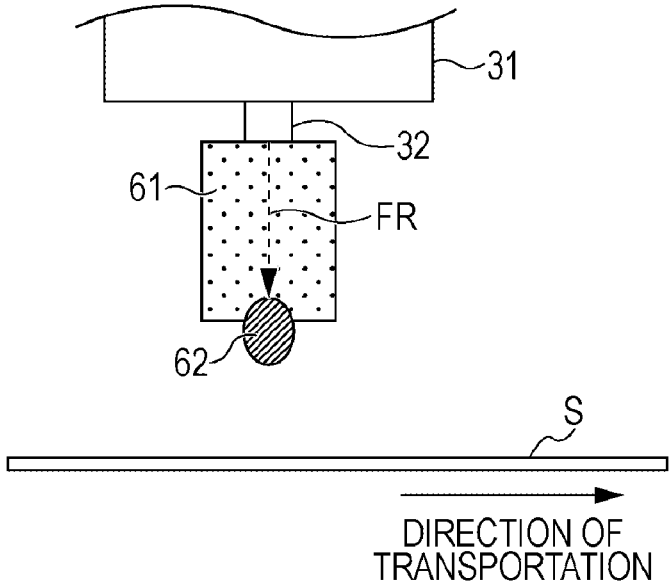
FIG. 5A is a schematic diagram illustrating a state in which ink is ejected from a nozzle and a mist portion and an ink main droplet are formed.
Figure 5B:
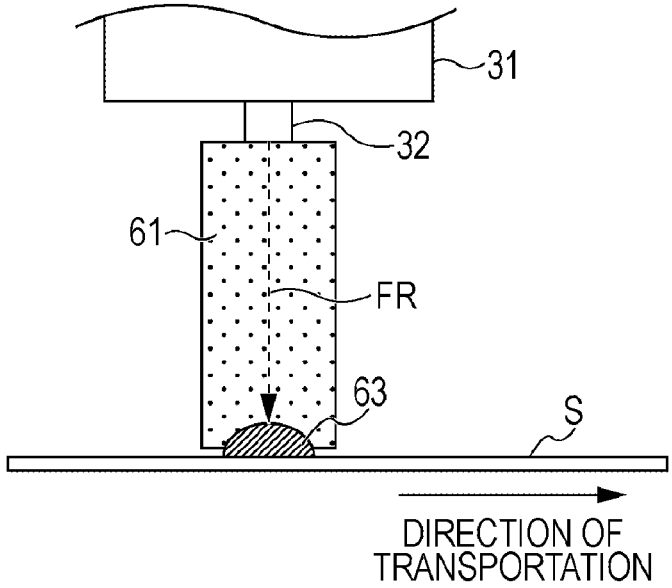
FIG. 5B is a schematic diagram illustrating a state in which the ink main droplet lands on a sheet and a dot is formed.

FIG. 5A is a schematic diagram illustrating a state in which ink is ejected from a nozzle 32 and a mist portion 61 and an ink main droplet 62 are formed. FIG. 5B is a schematic diagram illustrating a state in which the ink main droplet 62 lands on a sheet S and a dot 63 is formed.

As shown in FIG. 5A, when ink is ejected from a nozzle 32, most of the ink forms a droplet (hereinafter referred to as "an ink main droplet 62") and flies towards the sheet S along a flight route "FR". Then, as shown in FIG. 5B, the ink main droplet 62 lands on the sheet S and forms a dot 63 on the sheet S. However, when the nozzle 32 ejects the ink, part of the ink separates from the ink main droplet 62 and becomes a large number of minute droplets in the form of mist (hereinafter referred to simply as "mist"). Moreover, even when the ink main droplet 62 is flying towards the sheet S, part of the ink separates from the ink main droplet 62 and becomes mist. The mist thus formed floats around the flight route FR.

As shown in FIGS. 5A and 5B, most of the mist generated by one ejection of ink constitutes a cylindrical mist portion 61 whose axis is the flight route FR. Here, the mist portion 61 refers to those parts of the mist generated from the nozzle 32 by one ejection whose distances from the axis are within the range of the standard deviation ($\pm\sigma$).

Figure 6:
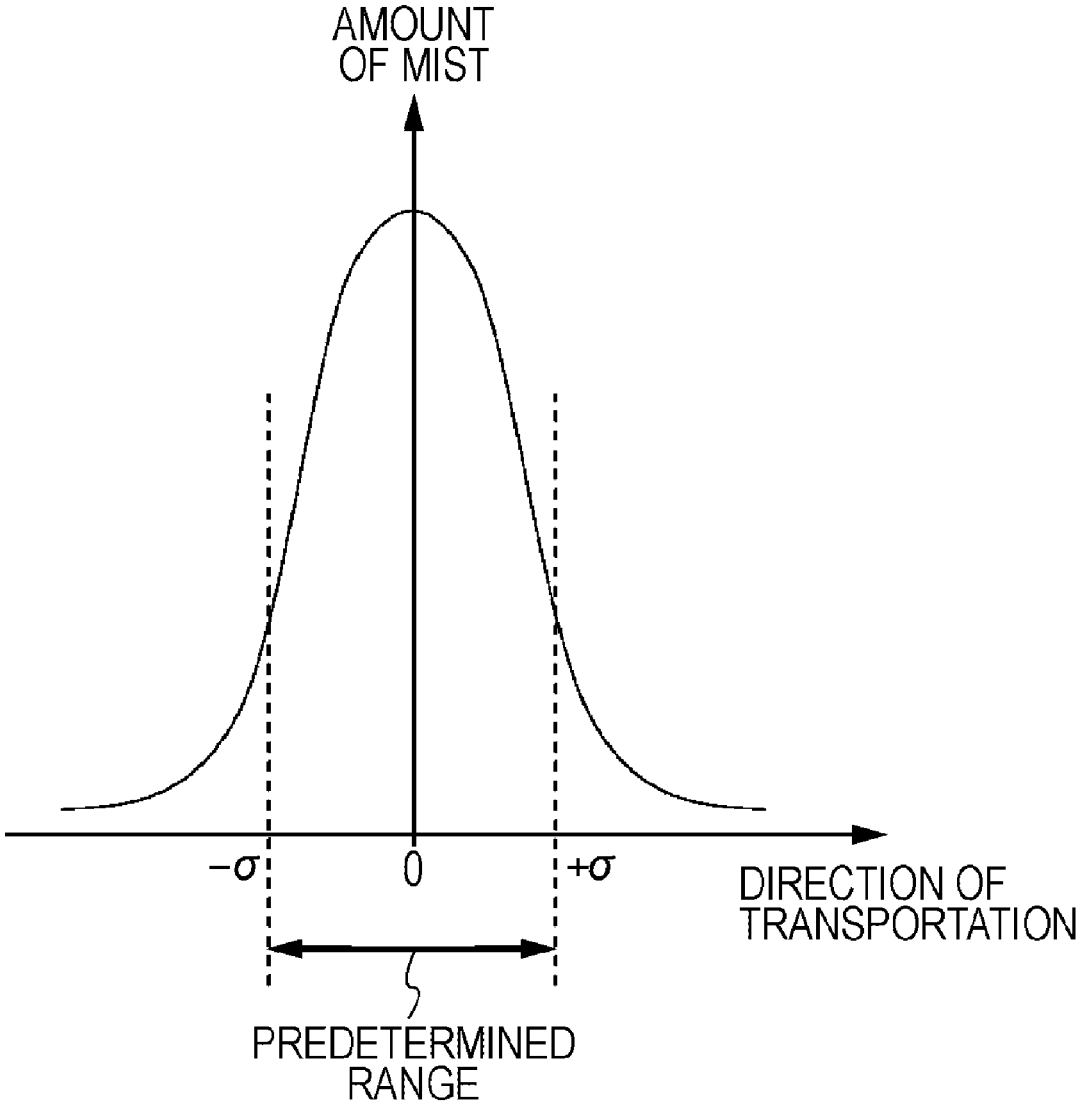
FIG. 6 is a graph showing the distribution of distances from the axis of a cylinder to individual parts of mist.

FIG. 6 is a graph showing the distribution of distances from the axis of the cylinder to individual parts of the mist. As shown in FIG. 6, the mist of the mist portion 61 is distributed generally in a certain range, although the range changes with the viscosity of ink, the diameter of the nozzle, and the ejection speed of ink. In FIG. 6, the mist portion 61 is represented as the portion of mist that is distributed in the range of $-\sigma$ to $+\sigma$.

In order to prevent the mist portion 61 from colliding and joining with an ink main droplet 62, the mist sucking unit 40 sucks air including the mist portion 61, so as to move the mist portion 61, which is on the flight route FR, from the flight route FR, along which ink travels after being ejected from the nozzle 32 until landing on the sheet S.

Figure 7:
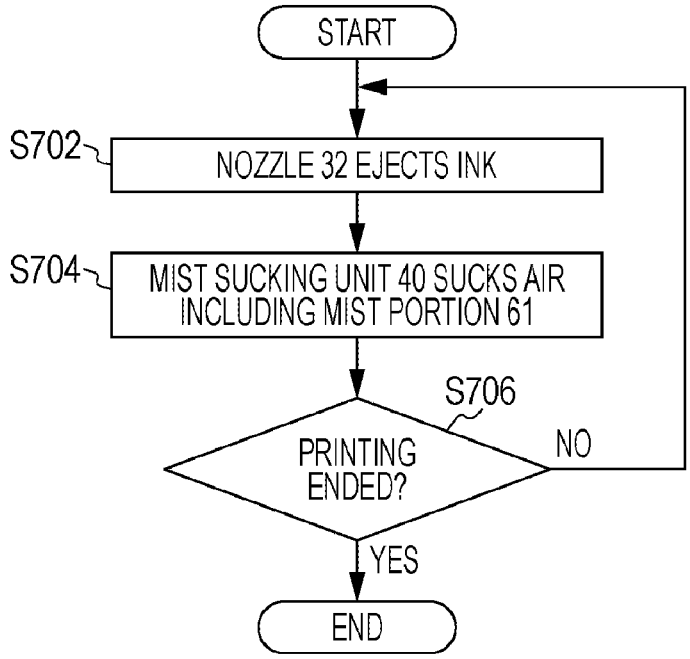
FIG. 7 is a flow chart illustrating the flow of operation when the mist sucking unit sucks air including a mist portion during printing.

FIG. 7 is a flow chart illustrating the flow of operation when the mist sucking unit 40 sucks air including the mist portion 61 during printing. As shown in FIG. 7, the nozzle 32 ejects ink (S702). As a result, the ink main droplet 62 lands on the sheet S and the mist portion 61 is generated around the nozzle 32.

Next, the mist sucking unit 40 sucks air including the mist portion 61 (S704). As a result, the mist portion 61 moves in the direction of the mist sucking unit 40, away from the flight route FR.

If the printing is ended by this ink ejection (S706: YES), the printing is ended. If the printing is continued (S706: NO), ink is again ejected (S702).

Figure 8:
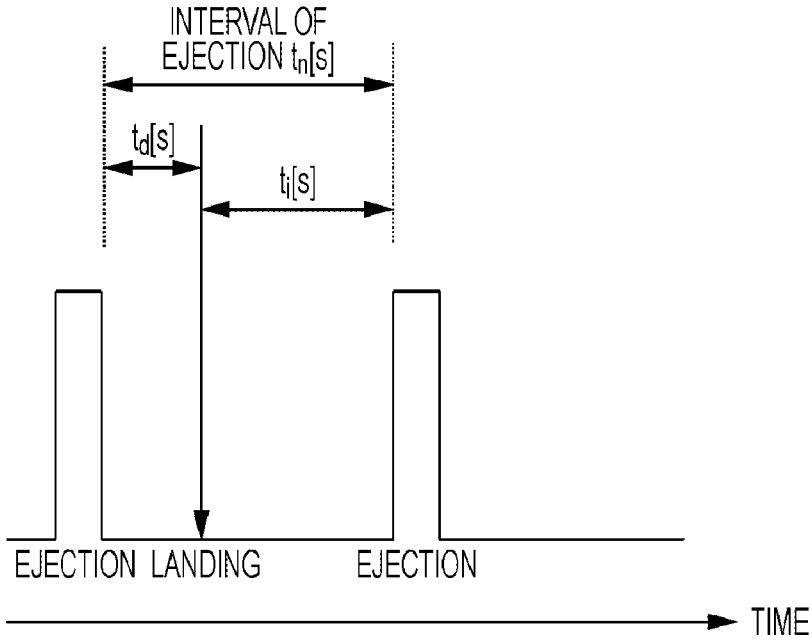
FIG. 8 is a schematic diagram illustrating the ejection and landing of ink in the flow of time.

FIG. 8 is a schematic diagram illustrating the ejection and landing of ink in the flow of time. The nozzle 32 ejects ink and, a time period $t_d$ [s] later, the ink main droplet 62 lands on the sheet S. The time period $t_d$ is the time for which the ink main droplet 62 flies. Simultaneously, ink that has become mist forms a mist portion 61. A time period $t_i$ [s] later than the landing, the nozzle 32 again ejects ink. This sequence is repeated until the printing is ended.

Here, it is necessary to move the mist portion 61 in the direction of the mist sucking unit 40 in the time period $t_i$ [s] from the landing until the next ink ejection. Therefore, the mist sucking unit 40 performs suction such that the average speed $v_m$ [m/s] of the mist portion 61 in the direction of the mist sucking unit 40 satisfies the following formula (1).

$$v_m \geq \frac{r_m}{t_n - \frac{d_{pg}}{v_d}} \tag{1}$$

$t_n$: time interval of ink ejection [s]
$v_d$: average speed of the ink droplet ejected from the nozzle 32 [m/s]
$d_{pg}$: distance between the nozzle 32 and the sheet S [m]
$r_m$: radius of the mist portion 61 in the direction along the plane of the sheet S [m]

The formula (1) is derived in the following manner.

Figure 9A:
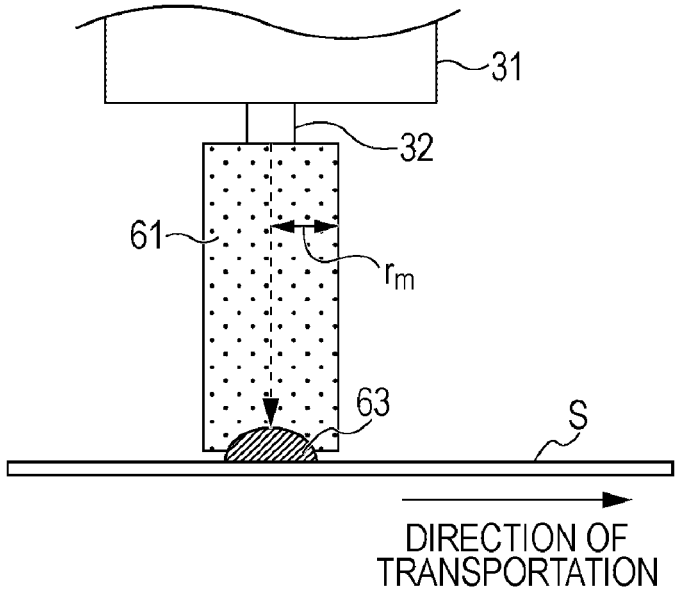
FIG. 9A is a schematic diagram illustrating the position of a mist portion relative to a nozzle when an ejected ink main droplet has just landed on a sheet and formed a dot.
Figure 9B:
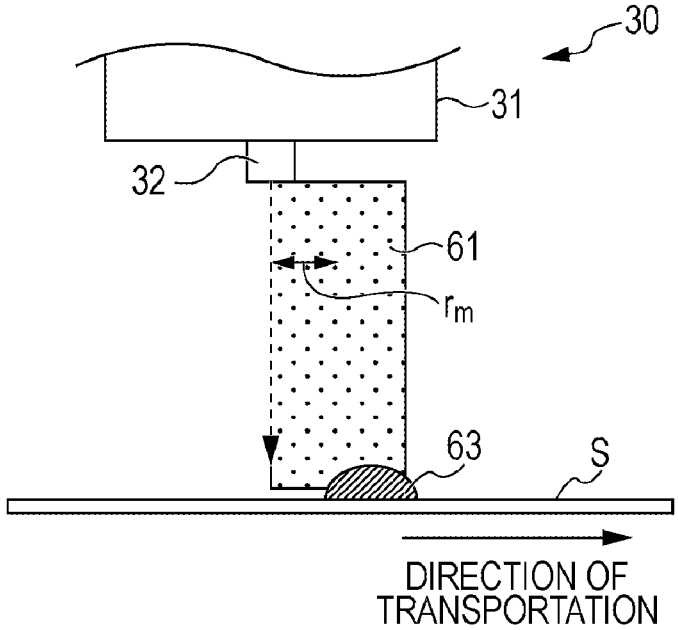
FIG. 9B is a schematic diagram illustrating the position of the mist portion relative to the nozzle on the next ink ejection.

FIG. 9A is a schematic diagram illustrating the position of the mist portion 61 relative to the nozzle 32 when the ejected ink main droplet 62 has just landed on the sheet S and formed the dot 63. FIG. 9B is a schematic diagram illustrating the position of the mist portion 61 relative to the nozzle 32 on the next ink ejection. As shown in FIG. 9A, when the ink main droplet 62 lands on the sheet S, the mist portion 61 is in the form of a cylinder having a radius of $r_m$ [m]. In order to prevent the mist portion 61 that is formed at this time from colliding and joining with the ink main droplet 62 of the next ejection, it is necessary to move the mist portion 61 to the position shown in FIG. 9B by the time the next ejection is performed. The distance of this movement is the radius $r_m$ [m] of the mist portion 61.

As illustrated in FIG. 8, the time period $t_i$ [s] from the landing of the ink main droplet 62 to the next ink ejection is obtained by subtracting $t_d$ [s] from $t_n$ [s], where $t_n$ [s] is the time interval of ink ejection, and $t_d$ [s] is the time period required for the ink main droplet 62 to land on the sheet S after being ejected from the nozzle 32. Here, the time period $t_d$ [s] required for the ink main droplet 62 to land on the sheet S from the nozzle 32 is obtained as $d_{pg}/v_d$ [s], where $d_{pg}$ [m] is the distance between the nozzle 32 and the sheet S, and $v_d$ [m/s] is the average speed of the ink main droplet 62 that is ejected from the nozzle 32 and lands on the sheet S. Therefore, the time period $t_i$ [s] from the landing of the ink main droplet 62 to the next ink ejection is given by the following formula (2).

$$t_i = t_n - \frac{d_{pg}}{v_d} \tag{2}$$

The minimum necessary average speed $v_s$ [m/s] of the mist portion 61 is obtained by dividing $r_m$ [m], which is the distance that the mist portion 61 has to move, by the time period $t_i$ [s], as in the following formula (3).

$$v_s = \frac{r_m}{t_i} \tag{3}$$

From the formulae (2) and (3), the following formula (4) is obtained.

$$v_s = \frac{r_m}{t_n - \frac{d_{pg}}{v_d}} \tag{4}$$

The average speed $V_m$ [m/s] of movement of the mist portion 61 in the direction of the mist sucking unit 40 has to be equal to or greater than the minimum necessary average speed $v_s$ [m/s] of the mist portion 61. Therefore, the following formula (5) is obtained.

$$v_m \geqq v_s \tag{5}$$

From the formulae (4) and (5), the following formula (6) is obtained.

$$v_m \geq \frac{r_m}{t_n - \frac{d_{pg}}{v_d}} \tag{6}$$

In the mist sucking unit 40, the rotation of the fan 43 is adjusted such that the formula (1) is satisfied. More specifically, such a rate of rotation of the fan 43 that satisfies the formula (1) is determined by setting the fan 43 at various rates of rotation.

As described above, in the present embodiment, the ejected ink main droplet 62 of the printer 1 before landing on the sheet S can be prevented from colliding with the mist portion 61 that is generated by the immediately previous ejection. Therefore, the image quality can be improved.

Moreover, when the mist sucking unit 40 is disposed on the downstream side of the nozzle 32 in the direction of transportation, the mist sucking unit 40 can move the mist portion 61 efficiently. When the sheet S is transported by the transporting unit 40, the air above the sheet S flows in the direction of transportation, owing to friction between the air and the sheet S. This flow of air cooperates with the suction by the mist sucking unit 40 so that the mist portion 61 can be efficiently moved in the direction of the mist sucking unit 40.

Moreover, when the air supplying unit 50 is provided between the head unit 30 and the mist sucking unit 40, the mist sucking unit 40 can efficiently suck mist other than the mist portion as well.

Other Embodiments

While the printer 1 that ejects ink to form an image has been described as an example of a fluid ejecting apparatus in the above-described embodiment, this is not limitative. Fluid ejecting apparatuses that eject fluid other than ink can also be embodied. Such other fluid includes liquid, a liquid-form product in which particles of a functioning material are dispersed, a gel-like liquid-form product, and a powder-form product that is a mass of fine particles.

For example, the invention can be applied to any one of a fluid ejecting apparatus that ejects fluid in which a material that is used in the manufacture of a liquid crystal display, an EL (electroluminescence) display, a surface-light-emitting display, or the like (such as a material for electrodes or a material for color) is dispersed or dissolved; a fluid ejecting apparatus that ejects organic matter of an organism, which is used in the manufacture of a biochip; a fluid ejecting apparatus that is used as a precision pipette and ejects specimen fluid; a fluid ejecting apparatus that performs pinpoint ejection of lubricating oil to a precision machine such as a timepiece or a camera; a fluid ejecting apparatus that ejects a transparent resin liquid such as ultraviolet-curing resin to a substrate in order to form a minute hemispherical lens (an optical lens) which is used in an optical communication device or the like; a fluid ejecting apparatus that ejects a liquid such as an alkali or an acid for the etching of a substrate; or a fluid ejecting apparatus that ejects gel.

The above-described embodiment has been described in order to facilitate understanding of the invention, and is not to be construed as limiting the invention. The invention can be changed or improved without departing from the spirit thereof, and equivalents of the invention are also within the scope of the invention. In particular, embodiments described below are within the scope of the invention.

Head Unit

In the first embodiment, the head 31 that ejects ink by using a piezoelectric element is used. However, the method of ejecting fluid is not limited to this method. Other methods, such as a method in which bubbles are generated in a nozzle by heat, may be used.

Transporting Unit

The sheet transporting unit 20 of the first embodiment is of a type which transports sheets along a plane. However, the sheet transporting unit is not limited to this type, and may be of other types such as a drum type.

Figure 10:
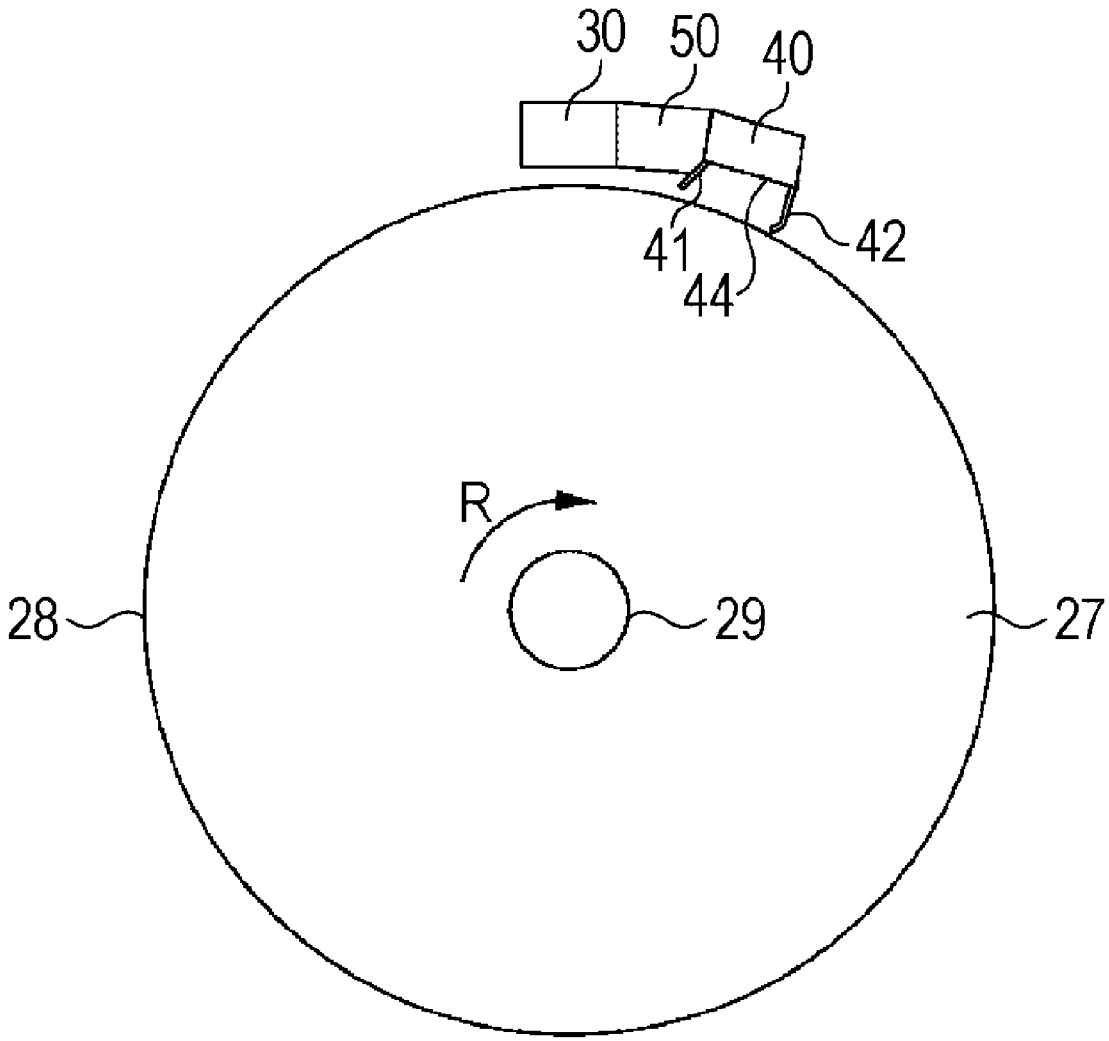
FIG. 10 is a sectional view illustrating the configuration of a drum-type printer that uses a fluid ejecting apparatus.

FIG. 10 is a sectional view illustrating the configuration of a drum-type printer 2 that uses a fluid ejecting apparatus of an embodiment of the invention. As shown in FIG. 10, the drum-type printer 2 has a rotating drum 27, a head unit 30, a mist sucking unit 40, and an air supplying unit 50.

The rotating drum 27 is a rotating member that rotates about a rotating shaft 29 while supporting a sheet S on a peripheral surface 28 thereof. The rotating shaft 29 is rotatably supported by a pair of frames (not shown) that are erected opposite each other, and rotates when driving force of a driving motor (not shown) is transmitted thereto. Thus, the rotating drum 27 rotates about the rotating shaft 29 at a certain angular speed in a direction indicated by an arrow R in FIG. 10.

The head unit 30, the mist sucking unit 40, and the air supplying unit 50 are configured basically similarly to those of the first embodiment.

Ink

The ink that is used may be ultraviolet-curing ink. In that case, the fluid ejecting apparatus has an ultraviolet-ray-radiating unit (not shown) that radiates ultraviolet rays to the medium to which the ultraviolet-curing ink adheres. The ultraviolet-ray-radiating unit is disposed on the downstream side of the head unit 30, the mist sucking unit 40, and the air supplying unit 50 in the direction of transportation.

What is claimed is:

1. A fluid ejecting apparatus comprising:

a nozzle that ejects fluid;

a transporting section that transports in a direction of transportation a medium on which the fluid lands;

a mist sucking section that sucks air including a mist portion when the nozzle ejects the fluid, so as to move the mist portion from a route that extends from the nozzle to a spot on the medium where the fluid lands, the mist portion being a portion of mist, which is part of the fluid ejected by the nozzle that does not land on the medium and is floating; and a controller controlling the mist sucking section such that for each occurrence of a first ejection followed by a second ejection, the mist formed from the first ejection is moved from the route prior to the second ejection.

2. The fluid ejecting apparatus according to claim 1, wherein the mist sucking section sucks air including the mist portion that is generated by an ejection, so as to move the mist portion from the route in a predetermined time period between the ejection and a next ejection.

3. The fluid ejecting apparatus according to claim 1, wherein the mist sucking section is disposed on the downstream side of the nozzle in the direction of transportation.

4. The fluid ejecting apparatus according to claim 1, further comprising:

a head that has the nozzle; and an air supplying section that is provided between the mist sucking section and the head, and that supplies air.

5. A fluid ejecting apparatus comprising:

a nozzle that elects fluid;

a transporting section that transports in a direction of transportation a medium on which the fluid lands;

a mist sucking section that sucks air including a mist portion when the nozzle elects the fluid, so as to move the mist portion from a route that extends from the nozzle to a spot on the medium where the fluid lands, the mist portion being a portion of mist, which is part of the fluid elected by the nozzle that does not land on the medium and is floating; and a controller controlling the mist sucking section such that for each occurrence of a first ejection followed by a second ejection, the mist formed from the first ejection is moved from the route prior to the second ejection and such that the formula $$v_m \geq \frac{r_m}{t_n - \frac{d_{pg}}{v_d}}$$

is satisfied, where $v_m$ [m/s] is the speed of movement of the mist portion in the direction of the mist sucking section, $t_n$ [s] is the predetermined time period, $v_d$ [m/s] is the speed of the fluid ejected by the nozzle, $d_{pg}$ [m] is the distance between the nozzle and the medium, and $r_m$ [m] is the radius of the mist portion.

6. A method of controlling a fluid ejecting apparatus, comprising:

providing a fluid ejecting apparatus, the fluid ejecting apparatus having a nozzle that ejects fluid, a transporting section that transports in a direction of transportation a medium on which the fluid lands, and a mist sucking section that sucks air including a mist portion, the mist portion being a portion of mist, which is part of the fluid ejected by the nozzle that does not land on the medium and is floating; and controlling the mist sucking section when the nozzle ejects the fluid, so as to move the mist portion from a route along which the fluid travels after being ejected from the nozzle until landing on the medium such that for each occurrence of a first ejection followed by a second ejection, the mist formed from the first ejection is moved from the route prior to the second ejection.

* * * * *